United States Patent [19]

Dalzell

[11] 4,116,645

[45] Sep. 26, 1978

[54] SOLID FUEL PACKAGE WITH IGNITER

[76] Inventor: Charles J. Dalzell, 940 N. 6th Ave., Yakima, Wash. 98902

[21] Appl. No.: 740,943

[22] Filed: Nov. 11, 1976

[51] Int. Cl.[2] ..... C10L 11/00

[52] U.S. Cl. ..... 44/38; 44/40; 44/41

[58] Field of Search ..... 44/38, 40, 41

[56] References Cited

PUBLICATIONS

In Re Van Beckum et al., 169 UsPQ 47.

*Primary Examiner*—Carl F. Dees

*Attorney, Agent, or Firm*—B. P. Fishburne, Jr.

[57] ABSTRACT

A nearly totally consumable clean and slow burning solid fuel assembly for home fireplace or camp fire features a large solid igniter which also serves as a cradle and stabilizer element for fuel log components. Plastic banding straps having low coefficients of expansion and contraction with temperature changes maintain the fuel assembly solidly intact during ignition and the center banding strap provides an excellent carrying handle. The spaced arrangement of log elements provides a built-in chimney effect with induced draft which is maintained during burning.

4 Claims, 9 Drawing Figures

FIG. 5
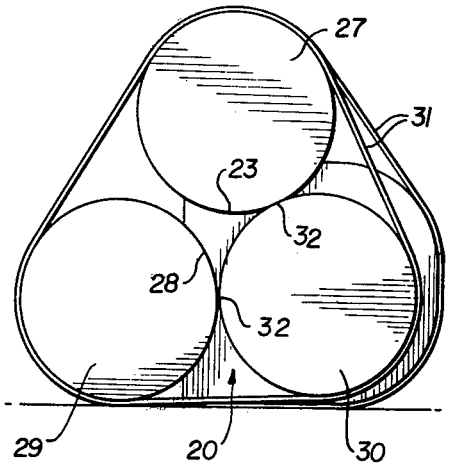
FIG. 6
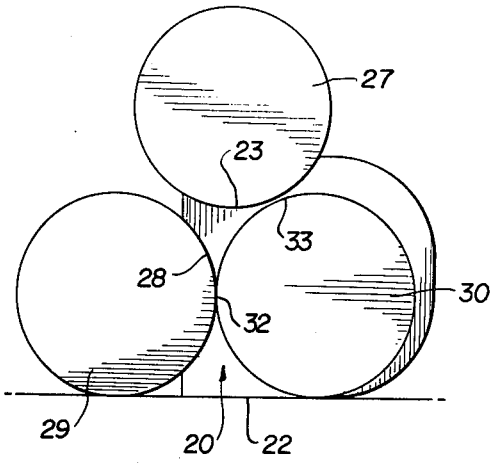
FIG. 7
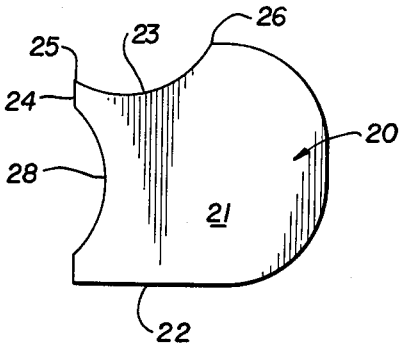
FIG. 8
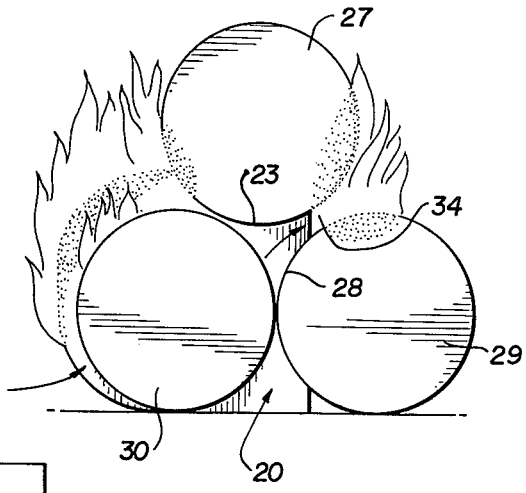
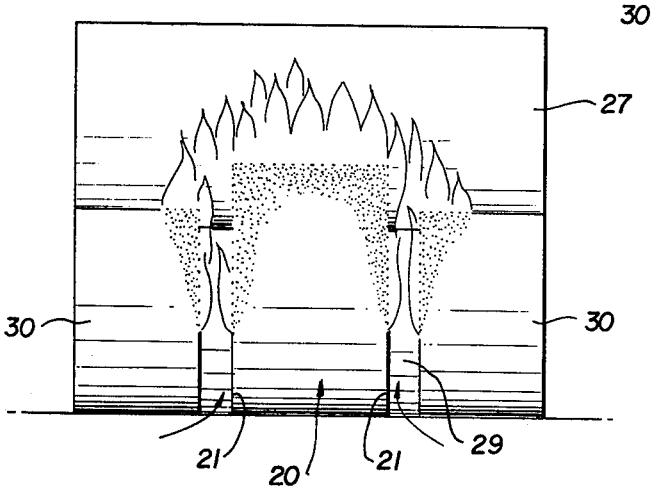
FIG. 9

SOLID FUEL PACKAGE WITH IGNITER

CROSS-REFERENCE TO RELATED APPLICATION

This application contains subject matter in common with prior copending application Ser. No. 668,942, filed Mar. 22, 1976, now U.S. Pat. No. 4,046,518, for SOLID FUEL ELEMENT AND PROCESS OF MANUFACTURING, Charles J. Dalzell, inventor.

BACKGROUND OF THE INVENTION

As a by-product of the domestic and international long term energy shortage, there is an increasing demand for more efficient and economical solid fuel units for burning in home fireplaces and at camp sites. The ever-increasing popularity of camping has stimulated the demand for a better solid fuel package which is convenient to carry and easy to ignite with a match. A number of artificial fireplace logs are available on the market and efforts are being made to supply consumers with more convenient and efficient solid fuel packages or units which are characterized by economy with slow and complete burning and with the absolute minimum of pollution. An example of the patented prior art is contained in U.S. Pat. No. 3,877,886 issued Apr. 15, 1975 for SOLID FUEL PACKAGE to Charles J. Dalzell.

The objective of this invention is to significantly improve on the known prior art through the provision of a solid fuel assembly or package which is easier to carry and handle, easier to ignite, and more stable, prior to igniting, during ignition and during the entire burning process.

A main feature of the improved article is embodied in a large solid igniter or starter element which also serves as a support cradle for the upper log of the assembly and as a positioning cradle or rest for the lower log, maintaining it properly spaced from the upper log for the most efficient induced draft during ignition and burning.

The solid igniter which forms a key element of the invention is produced in accordance with the process in prior copending application Ser. No. 668,942, filed Mar. 22, 1976, for SOLID FUEL ELEMENT AND PROCESS OF MANUFACTURING, Charles J. Dalzell, inventor. Such igniter is extremely efficient and, in addition to serving as an igniter or starter, forms an additional large slow-burning component of the solid fuel assembly.

A further feature of the invention resides in the utilization of low stretch tension bands which surround the fuel components and secure them in a naturally stable triangular array while providing a very convenient package carrying handle. The configuration of the assembly lends itself well to displaying on a pallet base and to shipment in multiple units while palletized. An advertising and instruction label can be conveniently held beneath the tension bands.

Other features and advantages of the invention will become apparent during the course of the following detailed description.

BRIEF DESCRIPTION OF THE DRAWINGS

FIG. 5 is an end elevation of the assembly with the tension bands intact.

FIG. 6 is a similar view of the assembly after the bands are consumed and illustrating the spacing of all solid fuel components at the beginning of burning.

FIG. 7 is an end elevation of the starter or igniter element.

FIG. 8 is a view similar to FIG. 6 illustrating burning of the fuel assembly and the induced draft or chimney feature.

FIG. 9 is a side elevation of the assembly shown in FIG. 8.

DETAILED DESCRIPTION

Figure 1:
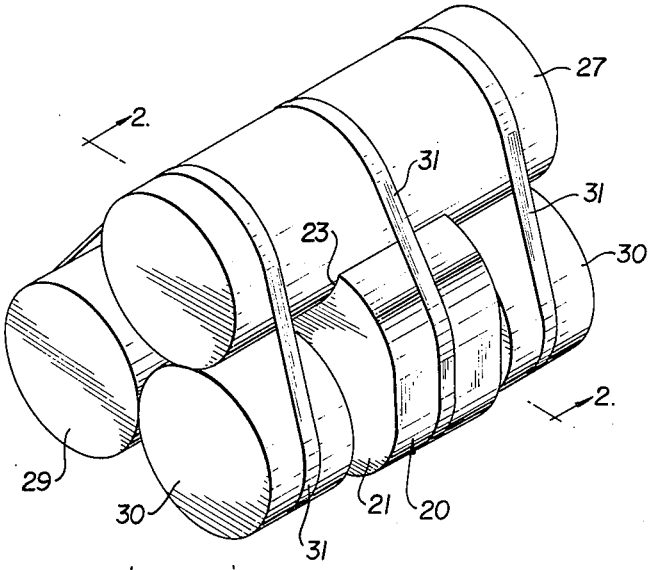
FIG. 1 is a perspective view of a solid fuel assembly for home fireplaces and camp fires embodying the invention.
Figure 2:
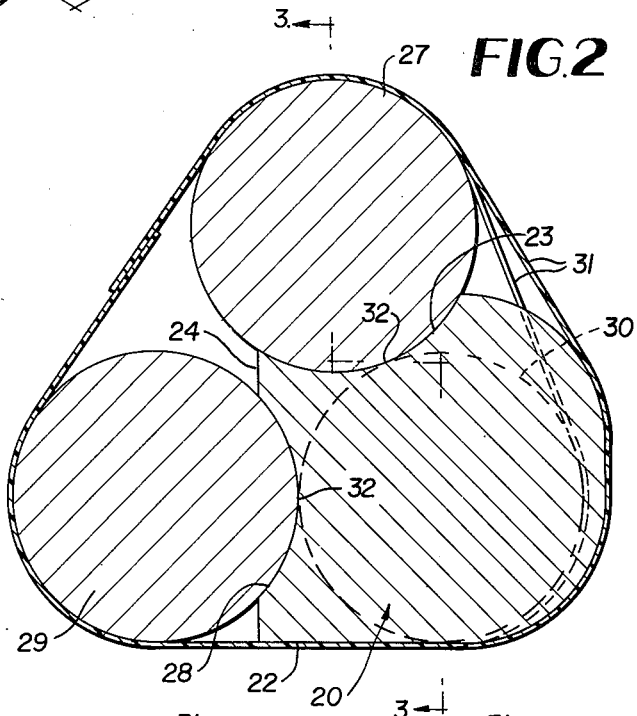
FIG. 2 is a transverse vertical section taken on line 2—2 of FIG. 1.
Figure 4:
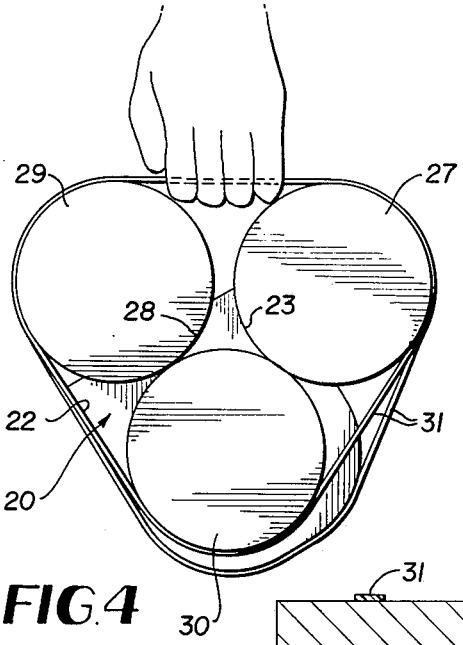
FIG. 4 is an end elevation of the fuel unit depicting the use of the carrying handle feature.

Referring to the drawings in detail wherein like numerals designate like parts, a solid fire starter or igniter element 20 forms a key element of the invention and is manufactured from fine powdery sawdust of compressed wood blended with liquid wax at an elevated temperature in accordance with the above-referenced patent application Ser. No. 668,942. The starter 20 will ignite readily with a match, is slow and even burning, and in addition to igniting the package or assembly serves as a major fuel element thereof.

The solid starter 20, in a practical embodiment of the invention, may be about three inches wide between its vertical end faces 21, although dimensions are not critical and may be varied. The starter has a flat bottom face 22 to rest on the floor of a fireplace or on the ground. Its height roughly approximates its width in the assembly, and the top of the starter 20 has a cylindrically curved seat 23 near its interior vertical edge 24. The bottom of the curved seat 23 is well below the two upper corners 25 and 26 thereof so that the seat will stably support and cradle an upper fuel log 27 of cylindrical form, such as a log formed from compressed dry wood shavings. A preferred product for making the log elements of this invention is an artificial fire log produced by the Weyerhaeuser Company of Tacoma, Wash. under the trademark "PRES-TO-LOG". Equivalent solid fuel compositions could be employed. In practice, the upper log may be about 10 inches long and about 4 inches in diameter and these dimensions may be varied in some cases. The radius of curvature of the seat 23 matches the radius of curvature of the upper log 27. The upper log rests on the starter 20 in a stable manner with its opposite ends projecting equidistantly from the end faces of the starter 20.

The starter 20 has a cylindrically curved recess or seat 28 formed centrally in its interior vertical side and this seat forms a rest and positioning means for a lower log 29 of the same dimensions as the upper log 27 and formed of the same composition. As is evident from the drawings, the seats 23 and 28 maintain a certain spaced relationship of the two logs 27 and 29 in the assembly to impart to the fuel assembly a certain induced draft or chimney effect during burning, which will be further described.

Figure 3:
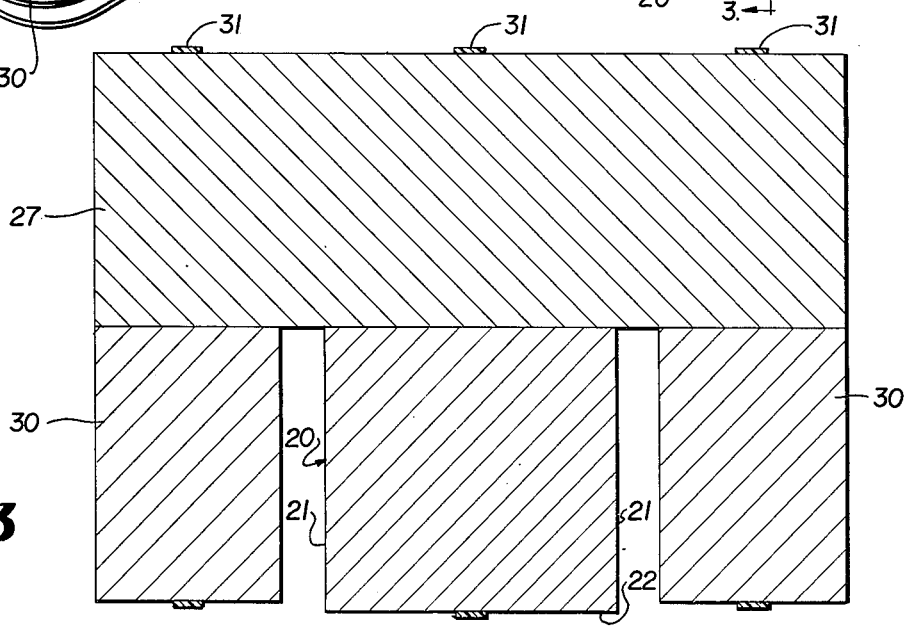
FIG. 3 is a vertical section taken on line 3—3 of FIG. 2.

At the side of the assembly away from the lower log 29, which might be called the front of the package, a pair of equally sized log slices 30 are placed on opposite sides of the starter 20 and are spaced therefrom by equal distances of about three-quarters of an inch, FIG. 3, to aid in the formation of the above-noted chimney effect or induced draft during burning. The outer end faces of the slices 30 are preferably flush with the end faces of the two main logs 27 and 29. The slices 30 are formed of the same compressed wood shavings and have the same diameters as the logs 27 and 29. The slices 30 have no engagement with the starter 20 in the assembly.

All elements of the fuel assembly or package are integrated and rigidly joined together by three tension bands 31 preferably formed of 400 pound test, Signode Contrax, applied around the solid fuel elements with about 70 pounds of tension, with the ends of the bands permanently joined by a known welding process. This banding material is manufactured and sold by Signode Corporation, 2600 N. Western Ave., Chicago, Ill. 60647. It is dimensionally stable with relatively little contraction or expansion with temperature changes.

The tension bands 31 hold the logs 27 and 29 firmly against the seats 23 and 28 and hold the log slices 30 in tangential contact as at 32 with the logs 27 and 29 until the bands are consumed by fire. When this occurs, as illustrated in FIG. 6, the slices 30 will drop slightly to the ground or fireplace floor by a distance of approximately 1/32 to ⅛ of an inch. This produces a slight gap at 33, FIG. 6, between the tops of log slices 30 and the upper log 27, whereby the slices do not bear any of the weight of the upper log which would tend to produce rolling of the slices 30 away from the two logs 27 and 29. This is an important feature which aids in maintaining the integrity of the assembly during a great part of the burning process.

A further and related feature of the invention is that the degrees of compression of the starter 20 and associated logs are chosen to render the assembly stable and non-collapsing during the longest possible burning period. By controlling compression of the solid fuel elements, the time of burning and the disintegration time of respective elements of the assembly can be controlled. In simple terms, as the cradling starter 20 burns so does the upper log 27, as depicted in FIGS. 8 and 9. As the upper log burns, its weight is reduced and the strength requirement of the cradling starter to sustain the upper log in the same elevated position is lessened in approximately equal proportion to the reduction in weight of the upper log. This allows the two elements 27 and 20 to maintain their relative positions in the assembly for up to two hours or more until the cradle element 20 is consumed.

This mode of operation is essential to maintaining the induced draft or chimney effect in the product which is another major feature of the invention. This draft effect is well illustrated in FIGS. 8 and 9 which depict the burning of the solid fuel product in relatively early stages. Draft air rises in the two passages between the slices 30 and the starter 20, as shown by the arrows in FIG. 9, and this updraft continues through the passage 34, FIG. 8, between top log 27 and bottom log 29. This induced draft produces even burning and burning over all regions of the assembly. Starter 20 is lit with a match, preferably near its bottom and near one end face 21. The starter ignites readily with a match and the flame spreads from the starter to the slices 30 and from the slices and starter to the top log 27. The updraft carries the fire to the rear lower log 29, as shown in FIG. 8, and gradually the burning spreads outwardly from the center toward the ends of the assembly, as well as upwardly. The burning is gradual and it has been found that a 17 pound assembly will ignite almost instantly with a match and will burn vigorously for up to two and one-half hours without requiring any attention. When the initial assemblage of elements finally disintegrates in a fireplace or on the ground, the remaining fuel can be adjusted with a poker and will burn with a live flame for thirty or forty extra minutes, finally leaving a bed of hot coals suitable for cooking or barbecueing for an additional half hour or more.

The unit is almost totally consumable including the tension bands 31 and leaves only a non-toxic residue. The product fully complies with Federal clean air emission standards for open burning and does not create an ecology problem by leaving non-recyclable residue.

The roughly triangular shape of the assembly is inherently stable so that the product will rest fixedly on any reasonably flat solid surface. It can be used in any fireplace with or without a grate.

As already mentioned, a simplified and convenient handle for the product is provided by the center band 31 which is readily gripped by the hand most conveniently between the two logs 27 and 29. The product lends itself very well to displaying in stores while stacked in layers on pallets. Multiple units of the product are palletized and steel-banded for shipment. A further feature is that the product unit has far greater "eye appeal" than similar products in the prior art and this enhances marketability. While not shown in the drawings, a large T-shaped label may be held under the three bands 31 and the label may span the entire front side of the upper log 27 as well as the front of starter 20 to provide a carrier for advertising, trade name, and instructions for use of the product.

The many advantages of the invention over the known prior art may now be understood by those skilled in the art without further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A solid fuel assembly comprising a unitary igniter and cradle element having a substantially flat bottom face adapted to rest on a level support surface and having substantially vertical end faces, said igniter and cradle element having an interior side provided with a log positioning arcuate recess and also having a top leg positioning arcuate recess above said side recess, an upper log whose length defines the length of said assembly resting stably in the upper arcuate recess of said igniter and cradle element, a lower log engaging in the side arcuate recess and positioned and stablized thereby relative to the upper log, and being of substantially the same length as the upper log, the bottom of the lower log being substantially flush with said flat bottom face of the igniter and cradle element, and a pair of log slices of considerably shorter lengths than the lengths of said upper and lower logs and disposed on opposite sides of said igniter and cradle element in spaced relation to said vertical end faces of such element and forming therewith a pair of spaced draft passages between said log slices and said igniter and cradle element, said side and top log positioning arcuate recesses maintaining said upper and lower logs in spaced substantially parallel relationship in said assembly and thereby forming a longitudinal draft passage in the assembly communicating with said pair of draft passages.

2. A solid fuel assembly as defined in claim 1, and said solid fuel assembly having a roughly triangular configuration as observed from either end of the assembly and said upper log disposed above and between the lower log and said log slices in a substantially symmetrical triangular array, said igniter and cradle element being between the log slices in said array and being offset laterally from the lower log and to a lesser extent offset laterally from the upper log.

3. A solid fuel assembly as defined in claim 1, and said igniter and cradle element, said upper and lower logs and log slices formed of compressed wood particles.

4. A solid fuel assembly as defined in claim 1, and combustible bands on said assembly securing said logs, log slices and igniter and cradle element in fixed assembled relationship and including an end pair of bands surrounding the upper and lower logs and log slices and a center band surrounding the upper and lower logs and the igniter and cradle element.

* * * * *